US005413497A

United States Patent [19]

Lwee

[11] Patent Number: 5,413,497

[45] Date of Patent: * May 9, 1995

[54] ELECTRICAL CONNECTOR

[76] Inventor: Nai Hock Lwee, 34196 Finnigan Terr., Fremont, Calif. 94555

[ * ] Notice: The portion of the term of this patent subsequent to Jul. 13, 2010 has been disclaimed.

[21] Appl. No.: 987,835

[22] Filed: Dec. 9, 1992

[30] Foreign Application Priority Data

Dec. 9, 1991 [JP] Japan ..... 3-324611

[51] Int. Cl.[6] ..... H01R 13/00

[52] U.S. Cl. ..... 439/328; 439/326

[58] Field of Search ..... 439/326–328, 439/629–637, 357, 358, 352

[56] References Cited

U.S. PATENT DOCUMENTS

| | | | |
|---|---|---|---|
| 3,823,367 | 7/1974 | Kaye et al. | 439/352 |
| 4,084,874 | 4/1978 | Georgopulos | 439/326 |
| 4,737,120 | 4/1988 | Grabbe et al. | 439/326 |
| 4,820,186 | 4/1989 | Fujii | 439/326 |
| 5,004,429 | 4/1991 | Yagi et al. | 439/326 |
| 5,203,714 | 4/1993 | Tuan | 439/326 |
| 5,226,833 | 7/1993 | Lwee | 439/326 |
| 5,242,312 | 9/1993 | Tondreault | 439/328 |

*Primary Examiner*—Gary F. Paumen
*Assistant Examiner*—Hien D. Vu
*Attorney, Agent, or Firm*—Woodcock, Washburn, Kurtz, MacKiewicz & Norris

[57] ABSTRACT

An electrical connector has an insulating housing with contact terminals which extend therethrough. The contact terminals are provided to electrically connect a mother board to a daughter board. A board-receiving opening is provided in the housing for reception of the daughter board therein. A pair of latch members are provided on the housing for latching the daughter board to take a predetermined posture with respect to the mother board. A pair of restricting metal plates are mounted on the housing for restricting the latch members from being flexed in a direction to move the paired latch members away from each other. A spring is provided in the board-receiving opening for enabling a spring force to be applied to the daughter board in a direction to urge the daughter board into the predetermined posture against a push force by the daughter board received in the board-receiving opening.

6 Claims, 6 Drawing Sheets

ELECTRICAL CONNECTOR

BACKGROUND OF THE INVENTION

1. Field of the Invention

The present invention relates to an electrical connector for electrically connecting together, for example, printed circuit boards.

2. Description of the Related Art

In a system including printed circuit boards, a daughter board, such as a single-in-line memory module (SIMM), is connected to a memory control board (called a mother board) for a system extension purpose.

An electrical connector has a plastic housing mountable on a mother board. The housing has a slot into which the daughter board is inserted.

The daughter board is connected to the mother board with the daughter board inserted in the slot of the housing. At this time, the daughter board has its attitude vertically fixed relative to the surface of the mother board. The daughter board thus fixed is electrically connected to those contact terminals arranged in the slot and placed in contact with the mother board.

In order to fix the daughter board at the vertical attitude, a pair of latch members are provided one at each end portion of the socket body such that they are integral with the socket body. Upon the insertion of the daughter board into the slot, the latch members are flexed in a direction to be moved by the daughter board away from each other, that is, are flexed outwardly of the socket body. Upon the full insertion of the daughter board's edge, the latch members are restored back to their initial configuration and the daughter board is sandwiched between the latch members. By so doing, the daughter board is fixedly held at a vertical attitude. Upon the detachment of the daughter board from the housing, the latch members are outwardly flexed in a direction to be moved away from each other. It is thus possible to withdraw the daughter board out of engagement with the latch members.

Since there is the need to detachably fix the daughter board to the mother board and to achieve their positive electrical connection, it is necessary to secure a ready attaching/detaching operation of both the boards and to ensure the reliability with which both the boards are firmly brought into engagement with each other. In those structures where emphasis is placed on their improved operation, the socket members are liable to produce cracks, defects, bends, etc., as well as involve inadequate durability, because the socket members, like the socket body, are made of plastics. Upon the repetitive attachment and detachment of the daughter board many times, the latch members are deformed beyond their elastic deformation limit and are difficult to restore back to its initial configuration due to a fatigue in the deformed area. As a result, a force acting to hold the daughter board in a sandwiched relation is lowered, thus being liable to produce a poor electrical connection between the daughter board and the associated contact terminals. There sometimes occurs a damage to, or a fracture of, the latch members.

SUMMARY OF THE INVENTION

It is according the object of the present invention to provide an electrical connector which is simpler in structure and lower in manufacturing cost and ensures not only high durability of latch members but also a firm electrical connection between a circuit board and contacts.

In order to achieve the aforementioned object of the present invention, there is provided an electrical connector for connecting a first circuit board to a second circuit board, comprising:

an insulating housing mountable on the first circuit board, the housing having a recess for receiving the second circuit board and a pair of latch members for latching the second circuit board to take a predetermined posture with respect to the first circuit board, the pair of latch members arranged in an opposed relation with the recess placed therebetween;

a plurality contacts positioned in the recess for establishing an electrical interconnection to the second circuit board;

a pair of restricting members for restricting the latch members from being flexed in a direction to move the paired latch members away from each other, the pair of restricting members arranged in an opposed relation with the paired latch members located therebetween; and spring means for enabling a spring force to be applied to the second circuit board in a direction to urge the second circuit board into the predetermined posture against a push force by the second circuit board received in the recess.

According to one embodiment of the present invention, the housing has a pair of guiding members for guiding the second circuit board to the recess, the pair of guiding member located in an opposed relation with the recess placed therebetween.

Preferably, the housing has a spring receiving cavity having an open lower end, the spring means being insertable into the spring receiving cavity though the lower end.

In this case, the restricting member has a supporting portion for supporting the spring means positioned in the spring receiving cavity and the supporting portion extends along the open lower end of the spring receiving cavity and covers the open lower end.

The latch member of the housing may has an area contacting with a lateral edge of the second circuit board, the latch member is tapered toward its base end at the contacting area.

Preferably, the latch member of the housing has a projection and the restricting member has a cutout engaging with the projection of the latch member.

According to the present invention, the flexing of the latch member is restricted by the restricting member, ensuring high durability of the latch member. Thus a stable and strong holding force can be maintained even at the repetitive attachment and detachment of the second circuit board.

A firm positive connection can be achieved between the first and second circuit boards by a mutual cooperation and coordination among the guide members, latch members and restricting members. It is possible to attach and detach the second circuit board to and from the socket body with a small force applied by a simple operation.

Further, the latch members may molded integral with the housing as in the conventional counterpart structure and hence a simpler structure is employed, thus not only improving their durability but also lowering the manufacturing cost.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

Figure 1:
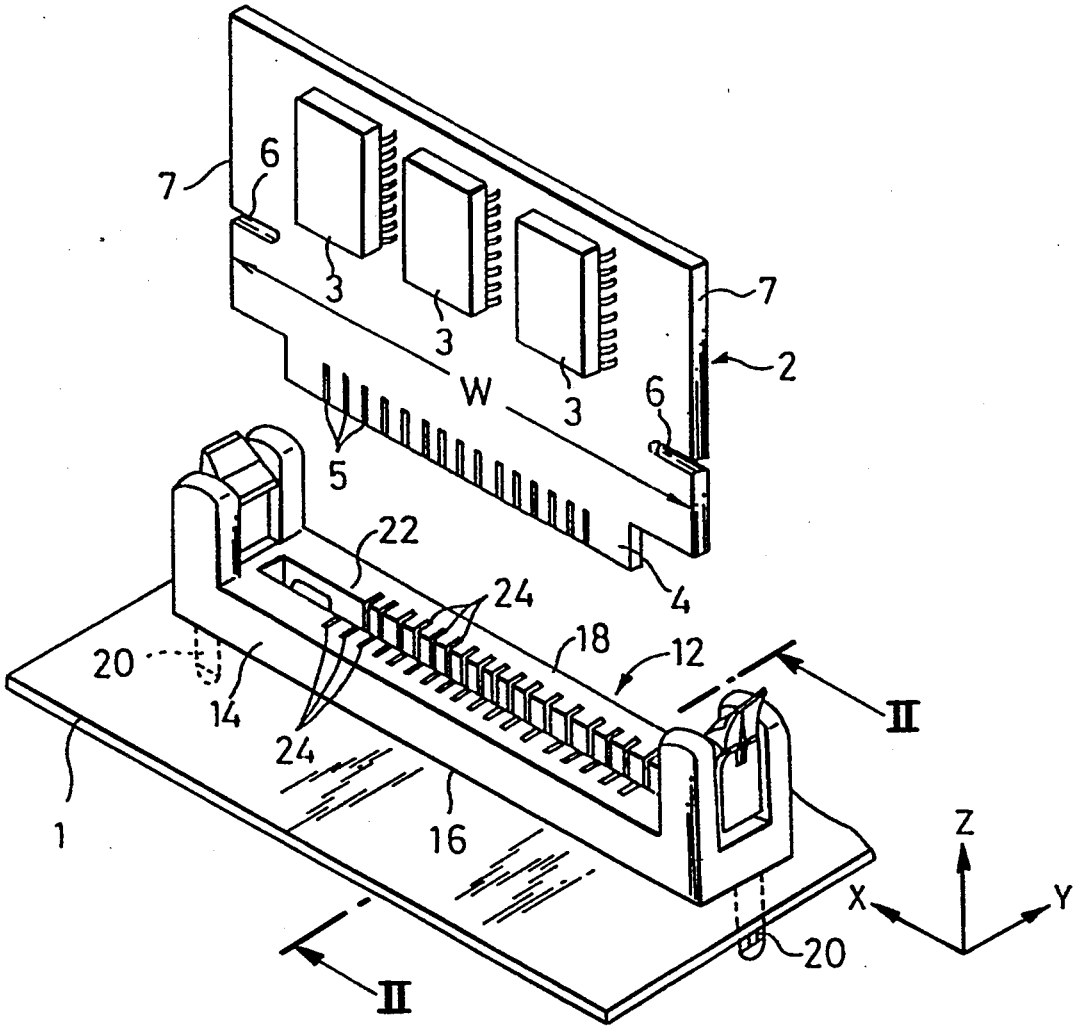
FIG. 1 is a perspective view showing an electrical connector with mother and daughter boards.

As shown in FIG. 1, an electrical connector 12 of the present invention is of such a type that a daughter board 2 is vertically connected to a mother board 1. The mother board 1 is comprised of, for example, a memory control board. The daughter board 2 is, for example, an SIMM (single-in-line memory module) on which memory chips 3 are mounted.

A plurality of solder pads 5 are provided at a base end portion 4 of the daughter board 2 such that they are arranged in a direction of the width of the daughter board 2. A slit 6 is provided at a predetermined position at each side portion of the daughter board 2.

The connector 12 has an elongated housing 14 molded of an elastic insulating material, such as plastics. In the following explanation, a direction X denotes the longitudinal direction of the housing 14 and width direction of the daughter board 2; a direction Y, the transverse direction of the housing 14; and a direction Z, the height direction of the housing 14.

The housing 14 has a bottom surface 16 to be mounted on the mother board 1 and a top surface 18 on which the daughter board 2 is mounted.

A leg 20 is provided at each end portion of the housing 14 and extends in the Z-direction at that location where the housing 14 is mounted on the mother board 1.

The legs 20 inserted through the mother board 1 are fixed in place by a soldering, etc., to allow an electrical connection to be done.

A board-receiving opening 22 is provided along the X-direction in that top surface 18 of the housing 14 where the daughter board is mounted. A plurality of contact terminals 24 are arranged, as a row array, in the opening 22 along the X-direction.

Figure 2:
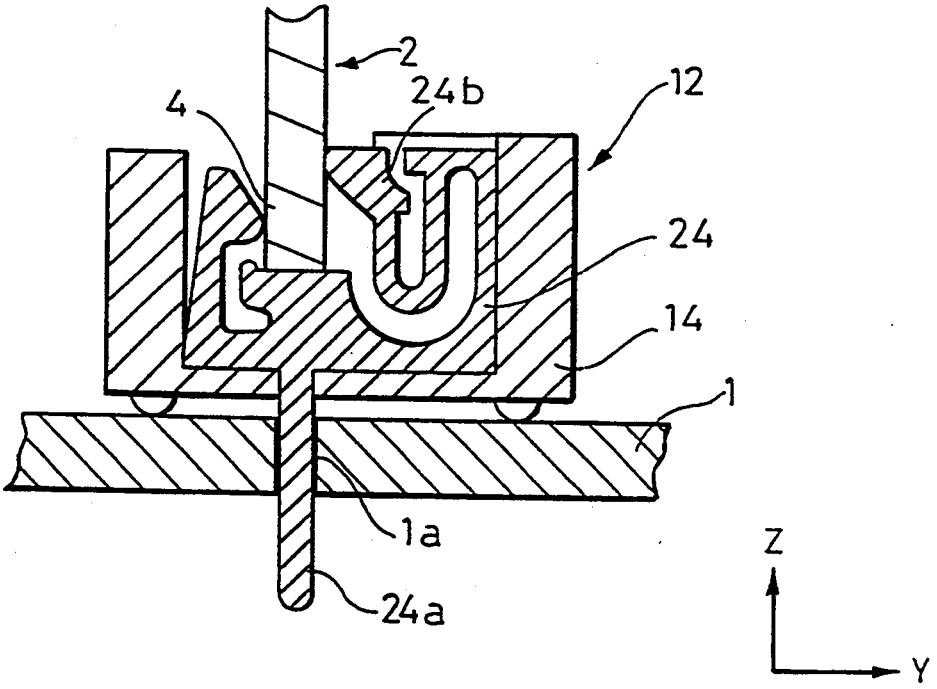
FIG. 2 is a cross-sectional view, as taken along line II—II in FIG. 1, showing a contacts in a housing.

The contact terminals 24 can be arbitrarily selected from the known elastic contact terminals for circuit board (SIMM, etc.) connection. The contacts 24 may be of such a type as indicated by a cross-sectional configuration in, for example, FIG. 2. The contacts 24 is electrically connected to the mother board 1 by a proper method for, for example, inserting one end portion **24*a* of the contacts 24 through a through hole 1*a* of the mother board 1**.

Figure 3:
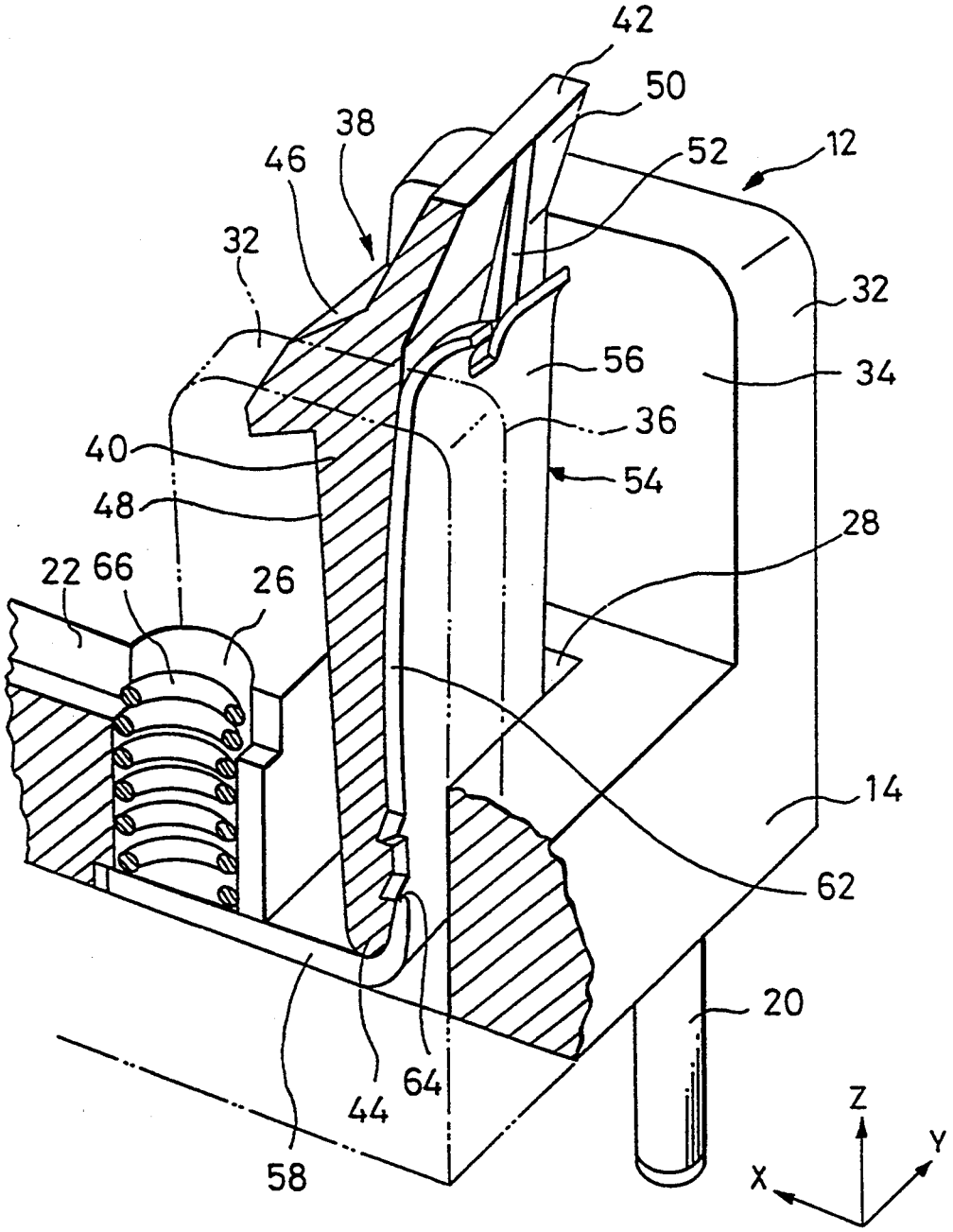
FIG. 3 is a perspective view, partly taken away, showing one end portion of the connector.
Figure 4:
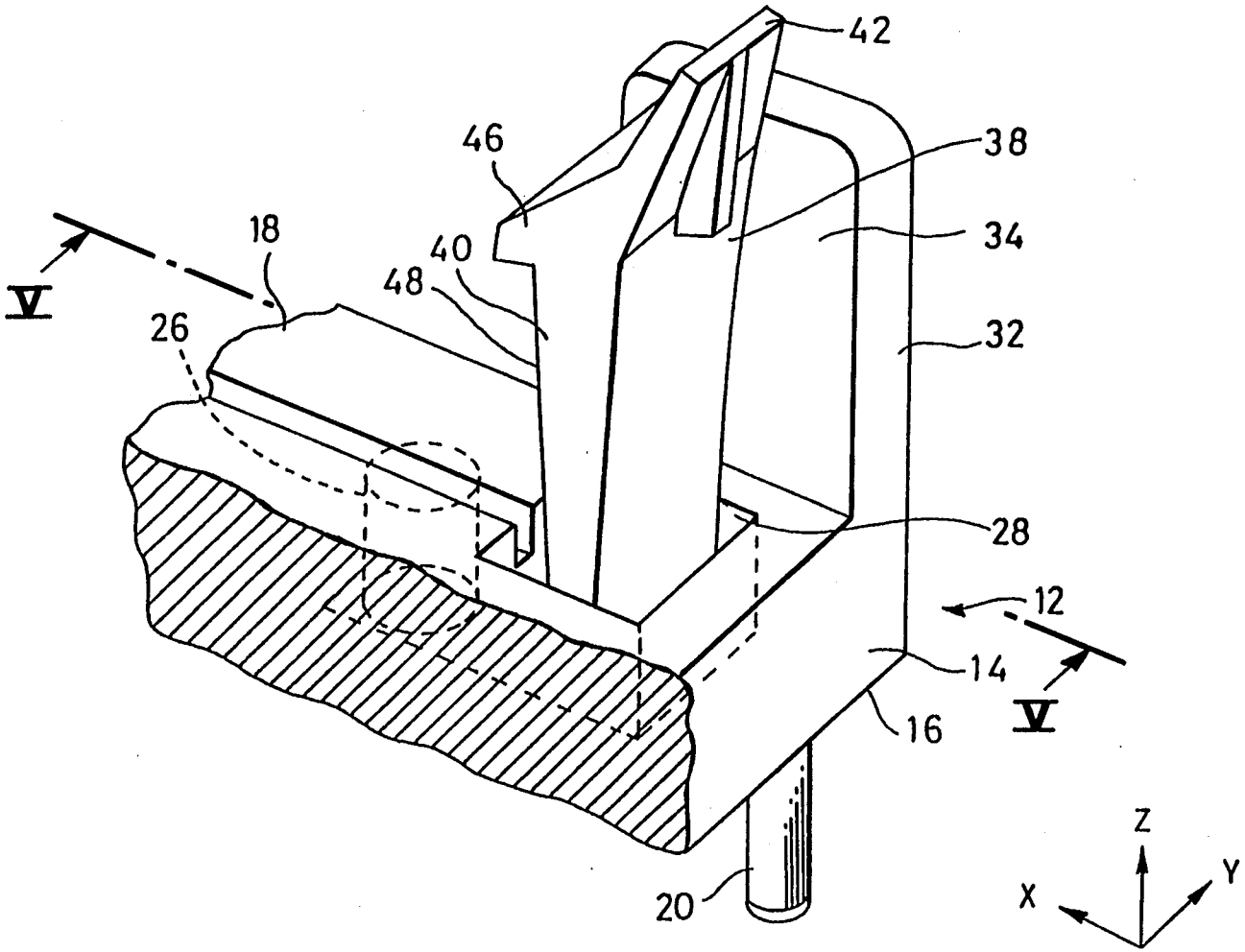
FIG. 4 is a perspective view, as partly taken away, showing one end portion of the connector with a reinforcing metal plate and coil spring omitted.

As shown in FIGS. 3 and 4, a spring receiving cavity 26 is provided in the housing 14 at an area near each end of the board-receiving opening 22 and extends from the bottom surface of the opening 22 toward the bottom surface 16, noting that one end portion only of the opening 22 is shown for brevity's sake.

Figure 5:
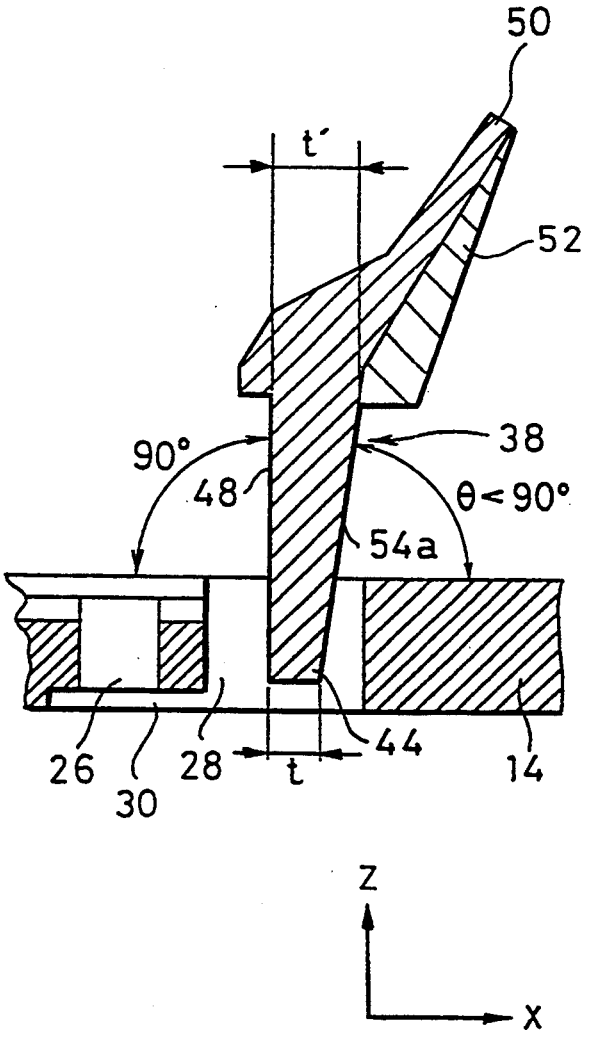
FIG. 5 is a cross-sectional view, taken along V—V in FIG. 4, showing one end portion of the connector.

As shown in FIGS. 3 to 5, a latch receiving cavity 28 is provided at each end side of the board-receiving opening 22. The cavity 28 extends through the housing 14 in the Z-direction and communicates with the opening 22 in the X-direction. The latch receiving cavity 28 communicates with the spring receiving cavity 26 via a recess 30 partially provided at the bottom surface 16 of the housing 14. A cover portion 58 of a reinforcing member 54 as will be set out below is so configured as to be fitted into the recess 30 of the housing 14.

A pair of guide arms 32 are molded integral with the housing 14 and arranged at each end portion of the top surface 18. The guide arms 32 have their opposed surfaces 34 and 36 in the Y direction with the latch receiving cavity 28 therebetween. A distance between the opposed wall surfaces 34 and 36 corresponds to the width of the daughter board 2.

A latch member 38 is located between the opposed wall surfaces 34 and 36 of the guide arms 32. The latch member 38 has its opposite side surfaces 40 provided integral with the opposed wall surfaces 34 and 36. Upper and lower ends 42 and 44 of the latch member 38 provided free ends. The lower end 44 of the latch member 38 is inserted into the latch member insertion hole 28. The opposed surfaces of the latch members 38, each, include a projection 46 engaging with the side slit 6 of the daughter board 2 and a support surface 48 to be abutted against a lateral edge 7 of the daughter board. The latch member 38 is elastically deformable in the X direction.

In the initial configuration of the latch member 38, the distance between the support surfaces 48 of the latch members 38 is made slightly smaller than the width W of the daughter board 2 so as to elastically hold both side edges 7 of the daughter board 2 between the support surfaces 48 and 48 of the latch members 38. The latch member 38 preferably has a grip 50 by which the daughter board 2 can be disengaged from the projections of the latch members. A rib 52 is projected on the outer surface of the grip 50.

The latch member 38 has its support surface 48 tapered as seen in cross-section. The X-direction width t of the latch member 38 at the lower end 44 of the support surface 48 is smaller than the X-direction width t' of the latch member 38 at the upper end of the support surface 48.

As shown in FIG. 5, the support surface 48 of the latch member 38 is set at an angle of 90° to the top surface 18 and the latch member 38 has an outer wall surface **54*a* set an angle smaller than 90° to the top surface 18. In the latch member 38 having such a structure, a force acting to urgingly hold the daughter board in the X direction between the pair of latching members 38 and 38 is automatically produced at the top end portions of the latch members 38. Upon the mounting of the daughter board it is not necessary to apply any excessive holding power from the reinforcing metal plate or member 54**. Thus a smaller force is required upon the mounting of the daughter board.

Referring to FIGS. 1 and 3, the paired reinforcing metal plates 54 are provided one at each end side of the top surface 18 of the housing 14 and each fixedly inserted in the latch receiving cavity 28. The reinforcing metal plates 54 are arranged in an opposed relation in a manner to hold the latch members therebetween.

Figure 6:
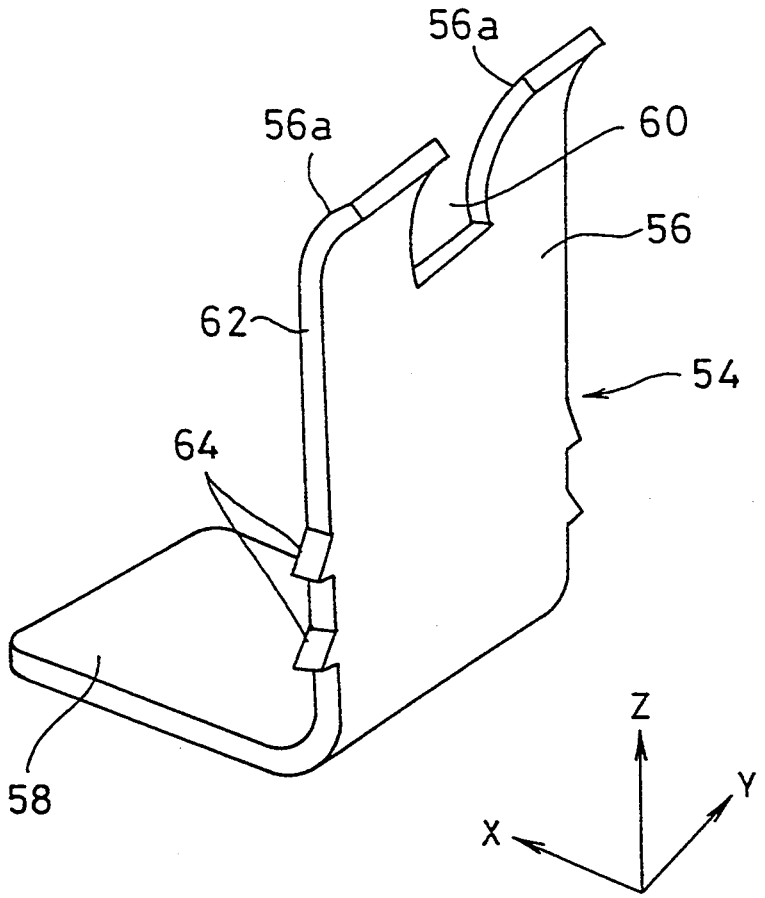
FIG. 6 is a perspective view showing the reinforcing metal plate.

As shown in FIG. 6, the reinforcing metal plate 54 is L-shaped in cross-section and has a reinforcing section 56 abutted against the outer surface side of the latch member 38 and cover section 58 for covering the lower surface of the spring receiving cavity 26. In the soldering of the connector 12 to the mother board 1, the cover section 58 of the reinforcing metal plate 54 holds a coil spring 66, as will be set out below, against a slippage out of the housing 14.

The reinforcing section 56 of the reinforcing metal plate 54 reinforces the latch member 38 and, upon the attachment and detachment of the daughter board, restricts the latch member 38 against any undesired flexing. A cutout slit 60 is provided at the upper end portion of the reinforcing metal section 56 of the reinforcing metal plate 54 to engage with a projection of rib 52 of the grip 50. Upon spreading the latch members 38 away from each other, the latch members 38 is restricted against any excessive flexing due to the rib 52 engaging with the slit 60 of the reinforcing metal sheet 54. It is thus possible to prevent a breakage of the latch member 38. In this case, a restricting member for restricting any excessive flexing of the latch member 38 can be provided by simply forming the cutout slit 60 at the plate-like reinforcing section 56 of the metal plate 56 located at the back of the latch member 36 in the X direction in which case the cutout slit 60 allows a displacement of the rib 52 resulting from the flexing of the latch member 38. Thus the restricting member is simpler in its structure.

The reinforcing metal sheet 54 restricts the latch member 38 from being flexed as set out above and does not serve to impart a supplementary holding force to the latch member 38 through the internal pushing of the latch member 38.

The top end **56*a* of the reinforcing section 56 of the reinforcing metal plate 54** is desirably curved so as to prevent its edge from damaging the latch member as shown in the Figure.

That portion of the side edge 62 of the reinforcing section 56 which is situated in the latch member insertion hole 28 has holding spikes 64 which bite into the inner wall of the latch member insertion hole 28. by so doing, the reinforcing metal sheet 54 is fixed to the housing 14.

The cover section 56 of the reinforcing metal plate 54 is fitted into the recess 30 of the mother board mount surface 16 of the housing 14 and covers the lower side of the spring receiving cavity 26. The coil spring 66 inserted in the cavity 26 is placed on the upper surface of the cover section 58 of the metal plate 54.

When daughter board 2 is to be mounted in the connector, the daughter board 2 is placed between the paired guide arms 32, 32 and 32, 32 with the base end 4 of the daughter board 2 down toward the board-receiving opening 22.

The daughter board 2 is slidably moved along the guide arms 32 toward the contacts 14 until the solder pads 5 of the daughter board 4 are seated into electrical connection with the contacts 14 at the opening 22. At this time, the projections 46 of the latch members 38 are pushed by the daughter board 2 to allow the latch members to be moved away from each other, while being elastically deformed.

With the base end 4 of the daughter board seated on the contacts 24, the projections 46 of the latch members 38 are brought into engagement with the side slits 6 of the daughter board 2 and the latch member 38 is elastically restored back to its initial configuration. At the same time, the support surfaces 48 of the latch members 38 are brought into abutting engagement with the lateral edges 7 of the daughter board to hold the daughter board 2 between the side surfaces of the latch members 38.

The coil spring 66 is compressed by the base end of the daughter board, producing a spring force for pushing up the daughter board 2. By so doing, the projection 46 of the latch member 38 is pushed against an upper edge **6*a* of the side slit 6 of the daughter board 2, urging the projection 46 into engagement with the slit 6. The daughter board 2 is positively held in place. This ensures a positive electrical connection between the solder pads 5 of the daughter board 2 and the contacts 24**.

Upon the detachment of the daughter board 2 from the connector 12, the latch members 38 are pushed away from each other. This operation is easier to do in the case where the handle 50 is provided integral with the latch member 38. This unlatches the daughter board 2 from the latch members 38. At this time, the daughter board 2 is pushed up under a vertical upward spring action of the coil spring 66 and ejected out of the contact terminals 24 and hence the opening 22. The unlatched daughter board 2 is pulled vertically out of the connector 12 until it is freely clear of the connector 12.

When the latch members 38 are deformed away from the housing 14 upon the attachment and detachment of the daughter board 2, the latch member 38 is restricted by the reinforcing metal plate 54 from being excessively flexed. This prevents a damage to the latch member 38 and ensures improved durability.

The present invention is not restricted to the embodiment set out above and various changes or modifications of the present invention can be made. For example, although the daughter board 2 mounted on the socket has been explained as taking a vertical attitude relative to the mother board 4, it may be so mounted as to take a horizontal or an oblique attitude relative to the mother board. As another example, a plurality of board-receiving openings 22 may be provided in one housing 14 and a corresponding number of daughter boards 2 may be provided in one socket in which case latch members 38, reinforcing metal plates 54, coil springs 66, and so on, are provided in each opening 22.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An electrical connector for connecting a first circuit board to a second circuit board, comprising:

an insulating housing mountable on the first circuit board, the housing having a recess for receiving the second circuit board and a pair of latch members for latching the second circuit board to take a predetermined posture with respect to the first circuit board, the pair of latch members arranged in an opposed relation with the recess placed therebetween;

a plurality of contacts positioned in the recess for establishing an electrical interconnection to the second circuit board;

a pair of restricting members for restricting the latch members from being flexed in a direction to move the paired latch members away from each other, the pair of restricting members arranged in an opposed relation with the paired latch members located therebetween; and spring means for enabling a spring force to be applied to the second circuit board in a direction to urge the second circuit board into a predetermined posture against a push force by the second circuit board received in the recess.

2. The electrical connector according to claim 1, wherein the housing has a pair of guiding members for guiding the second circuit board into the recess, the pair of guiding members located in an opposed relation with the recess placed therebetween.

3. The electrical connector according to claim 1, wherein the housing has a spring receiving cavity having an open lower end, the spring means being insertable into the spring receiving cavity through the lower end.

4. The electrical connector according to claim 3, wherein the restricting member has a supporting portion for supporting the spring means positioned in the spring receiving cavity and the supporting portion extends along the open lower end of the spring receiving cavity and covers the open lower end.

5. The electrical connector according to claim 1, wherein the latch member of the housing has an area that contacts a lateral edge of the second circuit board, and the latch member is tapered toward its base end at the contacting area.

6. The electrical connector according to claim 1, wherein the latch member of the housing has a projection and the restricting member has a cutout engaging with the projection of the latch member.

* * * * *